United States Patent [19]

Davis

[11] 4,013,013

[45] Mar. 22, 1977

[54] ORDNANCE FUZE TIME DELAY MECHANISM

[75] Inventor: Dale M. Davis, Freeport, Fla.

[73] Assignee: The United States of America as represented by the Secretary of the Air Force, Washington, D.C.

[22] Filed: Nov. 12, 1975

[21] Appl. No.: 631,279

[52] U.S. Cl. ..... 102/72; 102/75; 102/79

[51] Int. Cl.[2] ..... F42C 9/10

[58] Field of Search ..... 102/75, 74, 72, 79

[56] References Cited

UNITED STATES PATENTS

| | | | |
|---|---|---|---|
| 1,079,383 | 11/1913 | Wieser | 102/74 |
| 1,585,686 | 5/1926 | Pantoflicek | 102/74 |
| 2,381,900 | 8/1945 | Graumann et al. | 102/75 |
| 2,838,999 | 6/1958 | Corsi | 102/72 |
| 3,103,172 | 9/1963 | Hutchison et al. | 102/75 |
| 3,638,572 | 2/1972 | Menichelli | 102/75 |

FOREIGN PATENTS OR APPLICATIONS

| | | | |
|---|---|---|---|
| 987,453 | 3/1965 | United Kingdom | 102/74 |

OTHER PUBLICATIONS

The Condensed Chem. Dictionary, Hawley, G. G., Van Nostrand Reinhold Co., 1971, pp. 621 and 512.

*Primary Examiner*—David H. Brown
*Attorney, Agent, or Firm*—Joseph E. Rusz; Jacob N. Erlich

[57] ABSTRACT

A time delay mechanism for use within a fuze having a primer and propellant contained within respective housings, the ignition of which creates a pressure build-up utilized to activate the fuze. The exact time delay for the fuze is controlled by the length of time required for the propellant to create the desired pressure build-up.

8 Claims, 1 Drawing Figure

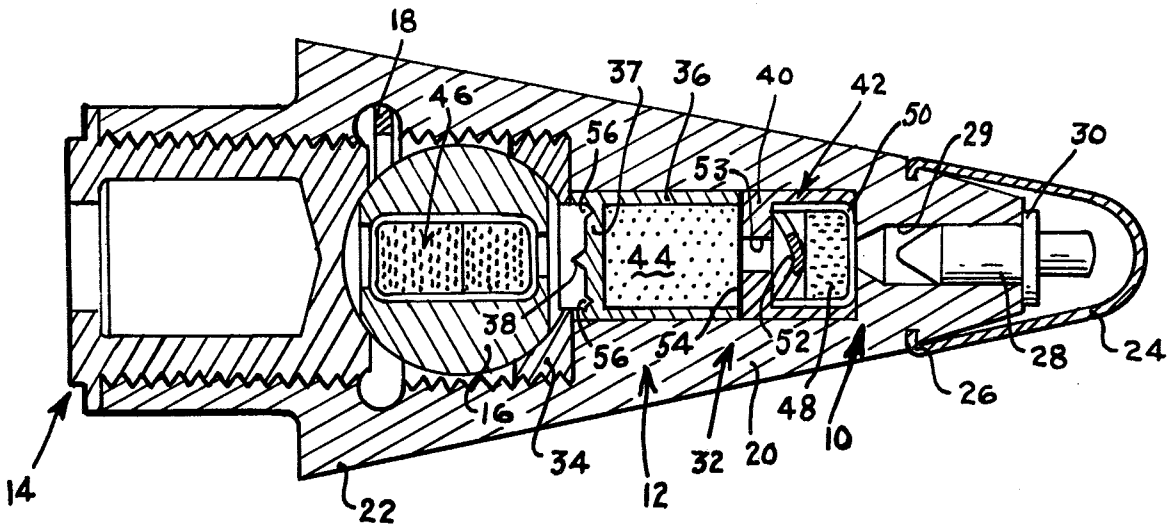
24
30
28
29
26
50
42
10
48
52
40
20
53
32
36
54
12
44
37
56
56
34
38
16
46
18
22
14

ORDNANCE FUZE TIME DELAY MECHANISM

STATEMENT OF GOVERNMENT INTEREST

The invention described herein may be manufactured and used by or for the Government for governmental purposes without the payment of any royalty thereon.

BACKGROUND OF THE INVENTION

This invention relates generally to ordnance fuzes, and, more particularly to a time delay mechanism capable of delaying the detonating action of a fuze utilized within a projectile.

It becomes necessary in many instances to destroy or disarm thin skinned material targets such as aircraft or the like which are capable of surviving the explosive force of most conventional weapons. There are two basis elements which must be considered in defeating such a target. First, it is necessary for the housing of the projectile to be of sufficient strength to pierce the protective shield of the target and second, the explosive action of the projectile must be capable of destroying the components located behind the skin of the target after such perforation. Merely punching a hole in the skin, in many instances, does not constitute a defeat or disablement of the aircraft.

Antiaircraft missiles or projectiles will generally detonate upon impact with the target such as an airplane, generally causing damage to the external configuration of the aircraft without doing substantial damage to the interior thereof. It is therefore desirable to incorporate in anti-aircraft projectiles and the like a delay which will permit the missile to penetrate the target before the main explosive chage is detonated thereby effecting maximum damage to the target.

The fuze is the mechanism utilized for igniting or detonating the bursting charge of such a projectile and performs this function upon impact of the projectile with any substantially rigid object, or in the case of a delay action fuze, at a predetermined time thereafter. Fuzes should be safe in handling and usage, free from deterioration in storage, simple in design and operation and easy to manufacture and load.

The desired delay time which is necessary in the anti-aircraft missiles or projectiles as set forth hereinabove is in the order of 0.25 milliseconds. Mechanical delay devices can produce the desired delay under certain conditions but the delay time is a direct function of striking velocity, target thickness, target density and impact angles. Pyrotechnic delays are useful for long delay times but are unreliable for the short times set forth hereinabove. It is therefore essential to produce a fuze which not only is capable of a millisecond delay period but which also meets the fuze criteria as set forth hereinabove.

SUMMARY OF THE INVENTION

The instant invention sets forth a time delay mechanism for utilization within conventional ordnance fuzes and which overcomes the problems set forth in detail hereinabove.

The time delay mechansim of this invention utilizes, a simple, inexpensive, and accurately reproducible pressure rise time of an impact primer or primer propellant combination in a confined volume tailored to provide any fuze time delay from less than 0.25 to several milliseconds. The fuze which incorporates the time delay mechanism of this invention therein is mounted within any conventional missile or projectile.

One type of fuze with which the time delay mechanism of this invention can be utilized is the well known spin-to-arm fuze or detonating system. In this system centrifugal force is utilized to activate the fuze and to align the detonator assembly thereof with the firing pin of the delay mechanism. Once the projectile strikes the target and penetrates therethrough the nose cap of the time delay mechanism will be crushed thereby setting into operation the time delay. The time delay incorporated therein is dependent upon the characteristics of the primer selected and the burning rate of the propellant so that a proper pressure can be achieved in order to obtain the desired functioning characteristics of the fuze. Upon the proper pressure being produced the firing pin of the time delay mechanism will come in contact with the detonator assembly and thereby explode the projectile after a predetermined time delay.

It is therefore an object of this invention to provide a time delay mechanism which is capable of delays of less than 0.25 to several milliseconds.

It is another object of this invention to provide a time delay mechanism which is simple in operation and the operation thereof is accurately reproducible.

It is still another object of this invention to provide a time delay mechanism which is economical to produce, reliable in operation and which utilizes conventional currently available components that lend themselves to standard mass producing manufacturing techniques.

For a better understanding of the present invention together with other and further objects thereof reference is now made to the following description taken in conjunction with the accompanying drawing and its scope will be pointed out in the appended claims.

DESCRIPTION OF THE DRAWING

The only FIGURE of the drawing is a side elevational view shown partly in cross section of the time delay mechanism of this invention incorporated within a spin-to-arm type fuze.

DETAILED DESCRIPTION OF THE PREFERRED EMBODIMENT

Reference is now made to the only FIGURE of the drawing which shows in detail the delay mechanism 10 of this invention which is incorporated within any coventional fuze, such as the well known spin-to-arm fuze 12 more commonly known as the USAF M505 fuze for 20mm M56 ammunition. Within this spin-to-arm fuze 12 the booster 14, ball rotor 16, and ball retainer 18 are all of conventional construction and operation.

Fuze delay mechanism 10 is located within one end 20 of fuze body 22. A crushable nose or end cap 24 preferably made of lightweight material is mounted on fuze body 22 within an indentation 26. This end cap 24 covers a firing element 28 which is capable of a sliding action within hole 29 on the front end 20 of body 22. Firing element 28 is retained within hole 29 by a retaining flange 30 until movement takes place in a manner to be described in detail hereinbelow.

The remaining delay mechanism components 32 are held within body 22 by a retainer 34 and are made up of the following parts: a rear housing 36 having an integral shear disc 37 and firing pin 38, a front housing 40, a primer assembly 42 and propellant 44.

The operation of the delay mechanism 12 of the instant invention takes place when the projectile (not shown) is in flight and the well known spin arming of fuze 12 has occurred. During this procedure centrifugal force has released retainer 18 from ball rotor 16 and the mass properties of the spinning ball has caused the alignment of ball 18 so that the detonator assembly 46 contained within ball 16 is aligned with firing pin 38 as shown in the drawing.

Once the projectile strikes a target nose cap 24 will crush on impact, striking firing element 28 thereby shearing the retaining flange 30 and driving the firing element 28 into primer assembly 42. Any suitable type primer 48 may be utilized within primer assembly 42. A preferable form of primer 48 may be a primer pellet of a pyrotechnic mixture of lead styphnate. The remaining elements of primer assembly 42 consist of a cup 50 for containing primer pellet 48 and an anvil 52. A flash hole 53 is also located in housing 40 for connection to propellant 44 in a manner to be described hereinbelow.

Upon being struck by firing element 28, primer cup 50 is indented crushing primer pellet 48 against anvil 52 causing it to ignite, burn, and vent through flash hole 53 into propellant 44. Propellant 44 may take the form of any fast burning granulation of single base or double base propellants such as nitro cellulose and nitro glycerin. The function of primer 48 will reliably occur within the time of about 0.1 miliseconds, the precise time depending on the exact characteristics of the primer selected.

The primer flash through flash hole 53 ruptures a foil seal 54 preferably of any lightweight material such as aluminum located adjacent flash hole 53. Ignition of propellant 44 then takes place causing it to burn at a known rate, the characteristics of which being based upon the propellant selected. By selecting propellants of various characteristics a wide variety of specific delay times can be achieved. As the propellant 44 burns it will increase the pressure in the housings to a predetermined point at which shear disc 37 defined by groove 56 in rear housing 36 will fail, propelling firing pin 38 into the detonator assembly 46. At this point the operation of a conventional spin-to-arm fuze 12 such as the M505 fuze or any other fuze is well known and which in this case consists of the explosion of detonator assembly 46 which shocks booster 14 which in turn detonates and propogates the detonation to the main charge of the projectile (not shown).

Although this invention has been described with reference to a particular embodiment it will be understood to those skilled in the art that this invention is also capable of a variety of alternate embodiments within the spirit and scope of the appended claims.

I claim:

1. In a fuze having a body and a detonator assembly the improvement therein being a fuze delay mechanism comprising a first housing in operative relationship with said detonator assembly, a propellant having a predetermined burning rate located within said first housing, a second housing located adjacent said first housing, a primer having a predetermined burning-rate located within said second housing, means operatively connected to said primer for initiating an ignition of said primer, said second housing containing an aperture therein adjacent said first housing, means located between said aperture and said first housing for separating said first housing and said second housing, said separating means capable of being ruptured at a predetermined time after the ignition of said primer and said first housing having a shear disc on the end opposite said separating means, said shear disc being capable of shearing when acted upon by a predetermined pressure build-up within said housings, whereby the ignition of said primer causes a subsequent ignition of said propellant thereby increasing the pressure within said housings to said predetermined level and said increase in pressure causes the shearing of said shear disc and subsequent detonation of said detonator assembly at a predetermined time delay after the initial ignition of said primer takes place.

2. A fuze as defined in claim 1 wherein said ignition initiating means comprises a firing element slidably mounted within said fuze body and in operative relationship with said primer.

3. A fuze as defined in claim 2 wherein said ignition initiating means further comprises a cover secured to said fuze body, said cover being capable of being crushed under a predetermined impact thereby activating said firing element.

4. A fuze as defined in claim 3 further comprising a firing pin mounted on said shear disc.

5. A fuze as defined in claim 4 further comprising a retaining flange operatively connected to said firing element for preventing the movement of said firing element until activation.

6. A fuze as defined in claim 5 wherein said ignition initiating means further comprises a cup and an anvil located within said second housing, said primer being located with said cup.

7. A fuze as defined in claim 6 wherein said primer is a pyrotechnic mixture of lead styphnate.

8. A fuze as defined in claim 7 wherein said propellant is in the form of nitro cellulose.

* * * * *